US010280484B2

(12) United States Patent
Kim

(10) Patent No.: US 10,280,484 B2
(45) Date of Patent: May 7, 2019

(54) ZINC ALLOY AND PREPARATION METHOD THEREFOR

(71) Applicant: KOREA INSTITUTE OF INDUSTRIAL TECHNOLOGY, Cheonan (KR)

(72) Inventor: Shae K. Kim, Seoul (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 732 days.

(21) Appl. No.: 14/443,975

(22) PCT Filed: Nov. 19, 2013

(86) PCT No.: PCT/KR2013/010488
§ 371 (c)(1),
(2) Date: Aug. 4, 2015

(87) PCT Pub. No.: WO2014/077653
PCT Pub. Date: May 22, 2014

(65) Prior Publication Data

US 2015/0361528 A1 Dec. 17, 2015

(30) Foreign Application Priority Data

Nov. 19, 2012 (KR) ..... 10-2012-0130717

(51) Int. Cl.
*C22C 18/00* (2006.01)
*C22C 1/03* (2006.01)
(Continued)

(52) U.S. Cl.
CPC ..... *C22C 1/03* (2013.01); *B22D 21/027* (2013.01); *C22C 1/06* (2013.01); *C22C 1/1084* (2013.01); *C22C 18/00* (2013.01)

(58) Field of Classification Search
CPC ..... C22C 18/00
See application file for complete search history.

(56) References Cited

U.S. PATENT DOCUMENTS

2015/0361528 A1* 12/2015 Kim ..... C22C 1/03 420/519

FOREIGN PATENT DOCUMENTS

CN 102071342 A 5/2011
CN 102146535 A 8/2011
(Continued)

OTHER PUBLICATIONS

Ha. Effect of CaO on Oxidation Resistance and Microstructure of Pure Mg.Materials Transactions, vol. 49, No. 5 (2008) pp. 1081 to 1083.*

(Continued)

*Primary Examiner* — Matthew E. Hoban

(57) ABSTRACT

The present invention provides a zinc alloy with improved alloy characteristics such as fluidity, castability, mechanical properties, corrosion resistance and elongation, and a preparation method therefor. The method for preparing the zinc alloy, according to one aspect of the present invention, comprising the steps of: providing zinc and a magnesium master alloy including a calcium-based compound; and forming a molten metal in which the magnesium master alloy and the zinc are melted; and casting the molten metal. The zinc alloy, according to another aspect of the present invention, includes a zinc base and the calcium-based compound present in the zinc base, wherein magnesium is applied to the zinc base.

12 Claims, 5 Drawing Sheets

(51) Int. Cl.

| | |
|---|---|
| ***B22D 21/02*** | (2006.01) |
| ***C22C 1/06*** | (2006.01) |
| ***C22C 1/10*** | (2006.01) |

(56) References Cited

FOREIGN PATENT DOCUMENTS

| | | | |
|---|---|---|---|
| DE | 2011584 | A1 | 4/1971 |
| JP | 11-279670 | A | 10/1999 |
| KR | 10-0681539 | B1 | 2/2007 |
| KR | 10-2011-0056210 | A | 5/2011 |
| KR | 10-2011-0135162 | A | 12/2011 |
| KR | 10-2012-0040652 | A | 4/2012 |

OTHER PUBLICATIONS

Ohishi. Age-hardening response of Mg-0.3 at.%Ca alloys with different Zn contents. Materials Science and Engineering A 526 (2009) 177-184.*

International Search Report for PCT/KR2013/010488 filed on Nov. 19, 2013.

* cited by examiner

[FIG. 1]
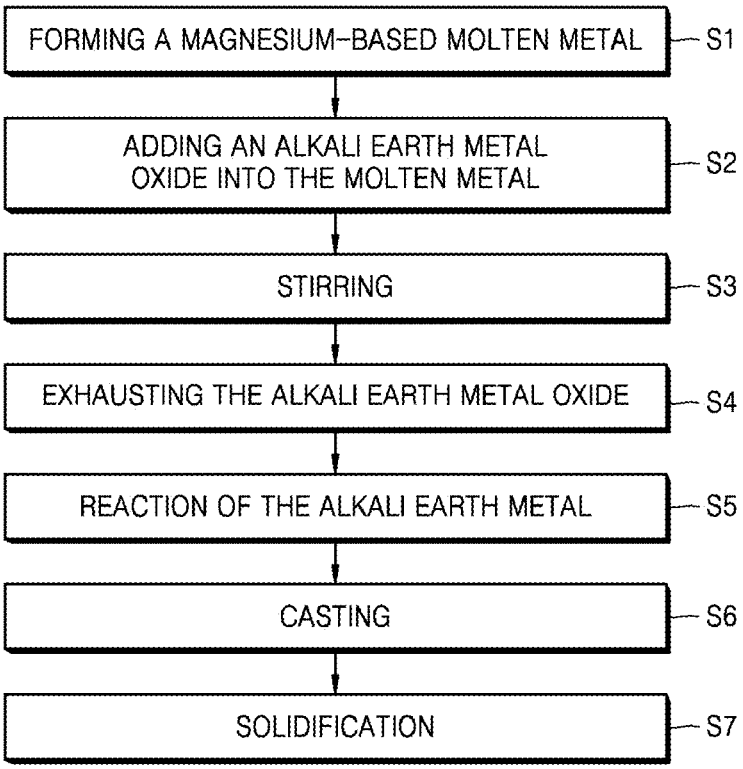
[FIG. 2]
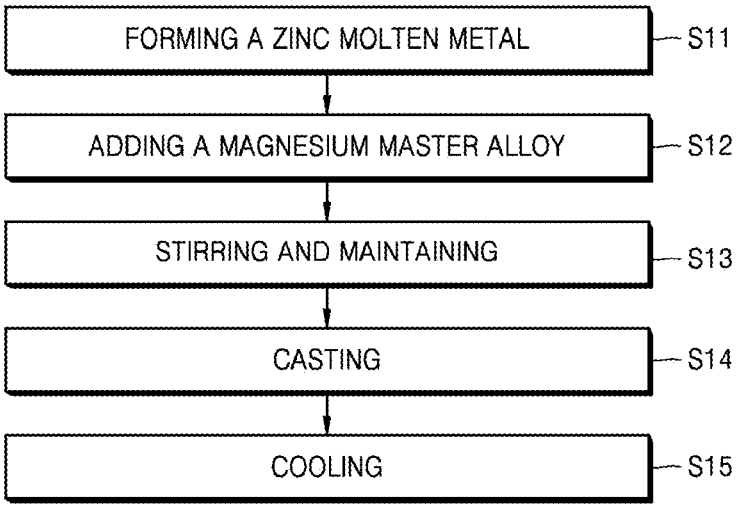

[FIG. 3]
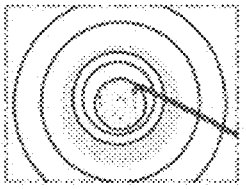
[FIG. 4]
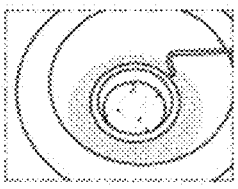
[FIG. 5]
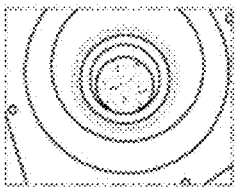
[FIG. 6]
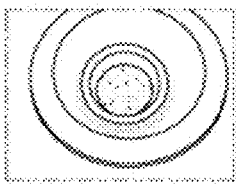
[FIG. 7]
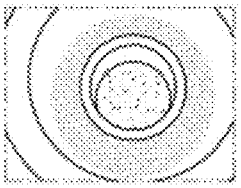
[FIG. 8]
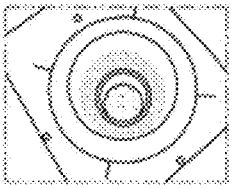

[FIG. 9]
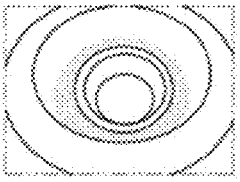
[FIG. 10]
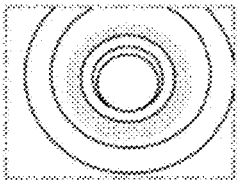
[FIG. 11]
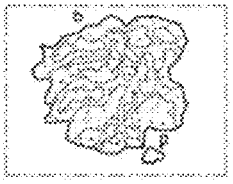
[FIG. 12]
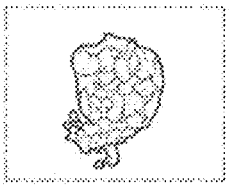
[FIG. 13]
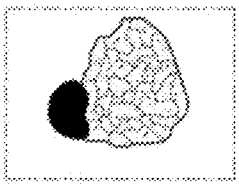
[FIG. 14]
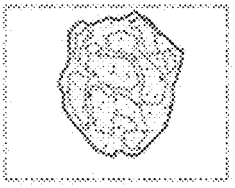

[FIG. 15]
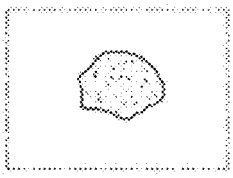
[FIG. 16]
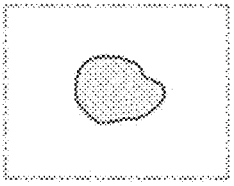
[FIG. 17]
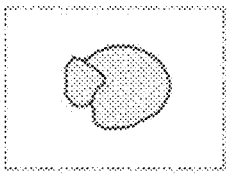
[FIG. 18]
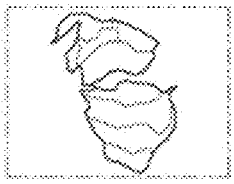
[FIG. 19]
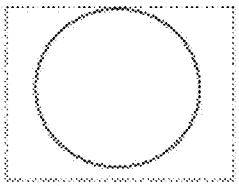
[FIG. 20]
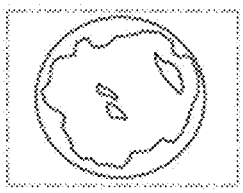

[FIG. 21]
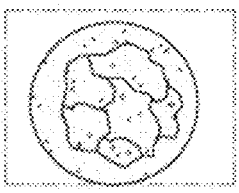
[FIG. 22]
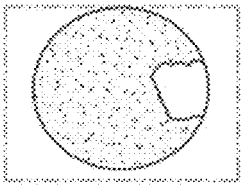
[FIG. 23]
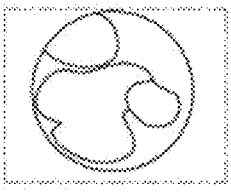
[FIG. 24]
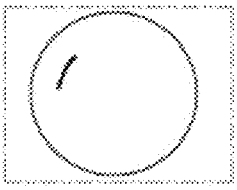
[FIG. 25]
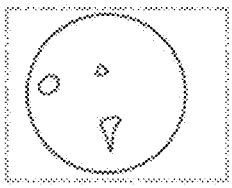
[FIG. 26]
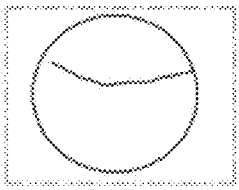

ZINC ALLOY AND PREPARATION METHOD THEREFOR

TECHNICAL FIELD

The present invention is related to an eco-zinc alloy and a preparation method therefor.

DESCRIPTION OF THE RELATED ART

Magnesium (Mg) is one major alloying element in the current element zinc (Zn) alloys. Most of zinc alloys include 90% or more of zinc, and from 1 to several % of aluminum, antimony, magnesium, copper, tin, etc.

Zinc alloys used for automobiles or radio parts with a die-casting method usually include 92% Zn, a small amounts of Mg, Cu, Al or Sn. However, this alloy has a low tensile strength (17 $kg/mm^2$) and low elongation. Thus, a zinc alloy having 4~5 weight % Al, 3 weight % Cu, and 92~93 weight % is currently used. Its tensile strength is 26~30 $kg/mm^2$, elongation is 2~3%, and HB is 80. This zinc alloy is easy to cast and has a clean surface of a casting product.

Zinc alloys for die casting are commercially available in a variety of names. For example, a minute Cahill alloy, an Apex alloy, a mirror metal, etc. In addition, there are a sleep metal used for an anode plate, including Al and Hg, and having a high corrosion resistance against free acids. In addition, there is a zinc alloy used for bearing metal. This zinc alloy has a low friction coefficient and a high compressive strength, and is cheaper than Sn or Pb alloys.

For example, this zinc alloy has a lumen bronze (80 weight % Zn, 10 weight % Cu, and 4 weight % Al), an El heart alloy (2.5 weight % Al, 1 weight % Pb and a small amount of Sn), or a Fenton alloy (80 weight % Zn, 14 weight % Sn, and 6 weight % Cu). In these alloys, a small amount of Mg element is added as an alloy element.

Recently, Mg is used as a major addictive element in zinc alloys, and the amount of Mg in zinc alloys increases. When Mg is added in a conventional zinc alloy, several problems can occur such as a quality degradation problem caused by the generation of a dross such as oxides and decrease problems in productivity and economic efficiency caused by a low actual addition amount of Mg.

DETAILED DESCRIPTION OF THE INVENTION

Technical Problem

The present invention has an objective to minimize oxides or inclusions formed during the formation of the zinc alloy by adding an eco-magnesium instead of a conventional magnesium which is one of additives for forming an zinc alloy. During this process, the present invention has an objective to improve mechanical properties of the zinc alloy and to increase internal qualities of the zinc alloy.

In addition, the present invention has an objective to improve the magnesium recycling ratio by minimizing the formation of oxides and to improve the economic efficiency of the formation of the zinc alloy by reducing the use of the high cost magnesium.

The present invention is not limited to the technical objective mentioned above, and other technical problems not mentioned above will be clearly understood to those of ordinary skill in the art from the following description.

Technical Solution

According to an aspect of the present invention, a preparation method for zinc alloy is provided. The preparation method for zinc alloy includes: providing a zinc and a magnesium master alloy including a calcium-based compound; forming a molten metal in which the magnesium master alloy and the zinc are melted; and casting the molten metal.

The magnesium master alloy may be input into and melted in the zinc molten metal or melted the zinc together. Herein, the zinc may be pure zinc or zinc alloy. Specifically, the forming the molten metal in which the magnesium master alloy and zinc are melted may include forming a zinc molten metal by melting a zinc; and adding the magnesium master alloy into the zinc molten metal and meting the magnesium master alloy In other embodiment of the method, the forming a molten metal may have inputting the magnesium master alloy and the zinc into a melting furnace; and melting the magnesium master alloy and the zinc together. The magnesium master alloy may be 0.01 through 46 weight % in the zinc alloy. Herein, the magnesium master alloy may be 5 through 30 weight % in the zinc alloy. The magnesium master alloy may be formed by adding a calcium-based additive into a pure magnesium or a magnesium alloy. The magnesium alloy may include aluminum.

The magnesium master alloy may be formed by: forming the molten metal by melting the pure magnesium or the magnesium alloy; and adding the calcium-based additive into the pure magnesium or magnesium alloy molten metal.

In other embodiment of the method, the magnesium master alloy may be formed by: inputting the pure magnesium or the magnesium alloy and the calcium-based additive into a melting furnace; and melting the pure magnesium or the magnesium alloy and the calcium-based additive together. Herein, the calcium-based additive added for forming the magnesium master alloy may have at least one of alkali earth metal oxides. Preferably, the alkali earth metal oxide may be calcium oxide (CaO). The alkali earth metal oxide may include at least one of calcium cyanamide ($CaCN_2$) and calcium carbide ($CaC_2$).

Thus, when the calcium-based additive is added in the pure magnesium or magnesium alloy to form an alloy, calcium (Ca) is reduced and separated from the calcium-based additive. The reduced calcium may react with other elements in the pure magnesium or magnesium alloy, for example, magnesium and/or aluminum, thereby forming the calcium-based compound in the magnesium master alloy.

Therefore, the calcium-based additive is a source of calcium used for forming the calcium-based compound in the master alloy and is an additive element added into the pure magnesium or magnesium alloy molten metal during forming the master alloy. While, the calcium-based compound is a newly formed compound by reacting the calcium provided by the calcium-based additive with the pure magnesium or the alloy elements of the magnesium alloy.

As described above, the calcium-based additive may be reduced in the magnesium molten metal. The calcium-based compound formed by the reaction of the calcium formed in the reduction process may have at least one of a Mg—Ca compound, an Al—Ca compound and a Mg—Al—Ca compound.

The Mg—Ca compound may include $Mg_2Ca$, The Al—Ca compound may include at least one of $Al_2Ca$ and $Al_4Ca$, and the Mg—Al—Ca compound may include $(Mg,Al)_2Ca$. The calcium-based additive may be added in the range of 0.0001 through 30 weight % with respect to the pure magnesium or the magnesium alloy.

The zinc alloy according to the present invention has a tensile strength greater than a tensile strength of a zinc alloy without the calcium-based compound. The zinc alloy according to the present invention has an elongation greater than or equal to an elongation of a zinc alloy without the calcium-based compound.

Advantageous Effects

As described above, according to the present invention, when a zinc alloy is formed, the generation of oxides or inclusions usually formed during the formation of the zinc alloy can be minimized by adding an eco-magnesium which formed by alloying an alkali earth metal from an alkali earth metal oxide, for example Ca from CaO. Therefore, the internal cleanness and mechanical properties of the zinc alloy product increase.

BRIEF DESCRIPTION OF THE DRAWINGS

FIG. 1 is a flow chart illustrating a preparation method of a magnesium master alloy (that is, eco-magnesium) adding to a zinc molten metal when a zinc alloy is manufactured, according to an embodiment of the present invention.

FIG. 2 is a flow chart illustrating a preparation method for a zinc alloy, according to an embodiment of the present invention.

FIG. 3 is a photograph illustrating a surface of a molten metal when a zinc alloy with a final composition of Zn-5 weight % Mg is formed by adding a conventional magnesium master alloy into a zinc molten metal.

FIG. 4 is a photograph illustrating a surface of a molten metal when a zinc alloy with a final composition of Zn-10 weight % Mg-10 weight % Al is formed by adding a conventional magnesium master alloy into a zinc molten metal.

FIG. 5 is a photograph illustrating a surface of a molten metal when a zinc alloy with a final composition of Zn-30 weight % Mg-20 weight % Al is formed by adding a conventional magnesium master alloy into a zinc molten metal.

FIG. 6 is a photograph illustrating a surface of a molten metal when a zinc alloy with a final composition of Zn-45 weight % Mg-5 weight % Al is formed by adding a conventional magnesium master alloy into a zinc molten metal.

FIG. 7 is a photograph illustrating a surface of a molten metal when a zinc alloy with a final composition of Zn-5 weight % Mg is formed by adding an eco-magnesium master alloy into a zinc molten metal.

FIG. 8 is a photograph illustrating a surface of a molten metal when a zinc alloy with a final composition of Zn-10 weight % Mg-10 weight % Al is formed by adding an eco-magnesium master alloy into a zinc molten metal.

FIG. 9 is a photograph illustrating a surface of a molten metal when a zinc alloy with a final composition of Zn-30 weight % Mg-20 weight % Al is formed by adding an eco-magnesium master alloy into a zinc molten metal.

FIG. 10 is a photograph illustrating a surface of a molten metal when a zinc alloy with a final composition of Zn-45 weight % Mg-5 weight % Al is formed by adding an eco-magnesium master alloy into a zinc molten metal.

FIG. 11 is a photograph illustrating a shape of a dross when a zinc alloy with a final composition of Zn-5 weight % Mg is formed by adding a conventional magnesium master alloy into a zinc molten metal.

FIG. 12 is a photograph illustrating a shape of a dross when a zinc alloy with a final composition of Zn-10 weight % Mg-10 weight % Al is formed by adding a conventional magnesium master alloy into a zinc molten metal.

FIG. 13 is a photograph illustrating a shape of a dross when a zinc alloy with a final composition of Zn-30 weight % Mg-20 weight % Al is formed by adding a conventional magnesium master alloy into a zinc molten metal.

FIG. 14 is a photograph illustrating a shape of a dross when a zinc alloy with a final composition of Zn-45 weight % Mg-5 weight % Al is formed by adding a conventional magnesium master alloy into a zinc molten metal.

FIG. 15 is a photograph illustrating a shape of a dross when a zinc alloy with a final composition of Zn-5 weight % Mg is formed by adding an eco-magnesium master alloy into a zinc molten metal.

FIG. 16 is a photograph illustrating a shape of a dross when a zinc alloy with a final composition of Zn-10 weight % Mg-10 weight % Al is formed by adding an eco-magnesium master alloy into a zinc molten metal.

FIG. 17 is a photograph illustrating a shape of a dross when a zinc alloy with a final composition of Zn-30 weight % Mg-20 weight % Al is formed by adding an eco-magnesium master alloy into a zinc molten metal.

FIG. 18 is a photograph illustrating a shape of a dross when a zinc alloy with a final composition of Zn-45 weight % Mg-5 weight % Al is formed by adding an eco-magnesium master alloy into a zinc molten metal.

FIG. 19 is a photograph illustrating an oxidation and ignition state of a surface of a casting product during solidification process after forming a zinc alloy with a final composition of Zn-5 weight % Mg by adding a conventional magnesium master alloy into a zinc molten metal.

FIG. 20 is a photograph illustrating an oxidation and ignition state of a surface of a casting product during solidification process after forming a zinc alloy with a final composition of Zn-10 weight % Mg-10 weight % Al by adding a conventional magnesium master alloy into a zinc molten metal.

FIG. 21 is a photograph illustrating an oxidation and ignition state of a surface of a casting product during solidification process after forming a zinc alloy with a final composition of Zn-30 weight % Mg-20 weight % Al by adding a conventional magnesium master alloy into a zinc molten metal.

FIG. 22 is a photograph illustrating an oxidation and ignition state of a surface of a casting product during solidification process after forming a zinc alloy with a final composition of Zn-45 weight % Mg-5 weight % Al by adding a conventional magnesium master alloy into a zinc molten metal.

FIG. 23 is a photograph illustrating an oxidation and ignition state of a surface of a casting product during solidification process after forming a zinc alloy with a final composition of Zn-5 weight % Mg by adding an eco-magnesium master alloy into a zinc molten metal.

FIG. 24 is a photograph illustrating an oxidation and ignition state of a surface of a casting product during solidification process after forming a zinc alloy with a final composition of Zn-10 weight % Mg-10 weight % Al by adding an eco-magnesium master alloy into a zinc molten metal.

FIG. 25 is a photograph illustrating an oxidation and ignition state of a surface of a casting product during solidification process after forming a zinc alloy with a final composition of Zn-30 weight % Mg-20 weight % Al by adding an eco-magnesium master alloy into a zinc molten metal.

FIG. 26 is a photograph illustrating an oxidation and ignition state of a surface of a casting product during solidification process after forming a zinc alloy with a final composition of Zn-45 weight % Mg-5 weight % Al by adding an eco-magnesium master alloy into a zinc molten metal.

BEST MODE

While the present invention has been particularly shown and described with reference to exemplary embodiments thereof, it will be understood by those of ordinary skill in the art that various changes in form and details may be made therein without departing from the spirit and scope of the present invention. The essential technical scope of the present invention is shown in the following claims, and any differences in the equivalent ranges of the essential technical scope of the present invention is included in the present invention.

Hereinafter, the present invention will now be described more fully with reference to the accompanying drawings, in which exemplary embodiments of the invention are shown. However, the present invention is not limited by the embodiments described later, but realized with various aspects. The embodiments in this description will make the disclosures of the present invention complete, and provide the scope of the invention to those of ordinary skill in the art.

Preparation Method for a Magnesium-Based Master Alloy (Eco-Maqnesium)

The magnesium-based master alloy used in the present invention use a magnesium master alloy called an eco-magnesium. Herein, the eco-magnesium is formed by applying an alkali earth metal oxide (for example, CaO) on a surface of a magnesium (pure magnesium or magnesium alloy) molten metal, and then stirring the surface of the molten metal to generate a surface reaction of the alkali earth metal oxide with the molten metal when the magnesium alloy is formed.

FIG. 1 is a flow chart illustrating a preparation method of magnesium master alloy, according to an embodiment of the present invention. As shown in FIG. 1, the preparation method of a magnesium master alloy according to the present invention includes: forming a magnesium-based molten metal (S1), adding an alkali earth metal oxide (calcium oxide, CaO, for the present invention) (S2), stirring (S3), exhausting the alkali earth metal oxide (S4), performing the reaction of the alkali earth metal (S5), casting (S6), and performing solidification (S7). The exhausting the alkali earth metal oxide (S4) and the performing the reaction of the alkali earth metal (S5) is separated for explanation, these steps (S4, S5) occur almost at the same time.

In the forming magnesium-based molten metal (S1), a magnesium or a magnesium alloy is input in a crucible and heated to the temperature of 400 through 800° C. under a protection gas atmosphere, thereby forming a magnesium-based molten metal. When the temperature is less than 600° C., it is difficult to form the magnesium molten metal. Herein, when the temperature is more than 800° C., the magnesium-based molten metal may be ignited.

In the adding the additive (S2), the additive is added into the molten metal of the pure magnesium or the molten metal of the magnesium alloy. The additive is preferably a powder form to increase surface areas for the reaction with the molten metal. However, when the particle size of the additive is fine, for example, less than 0.1 μm, the additive may be lost by sublimated magnesium or heat wind and then may not be input into the furnace. Furthermore, the additive may be agglomerated to form a cluster, and then the clustering additive may not dissolved in the meted metal. When the particle size of the additive is big, the surface area of reaction may be decrease. The preferable particle size of the additive powder is in the range of 0.1 through 500 μm. The more preferable particle size of the additive powder is equal to or less than 200 μm.

In the adding the additive (S2), the additive may be added in the range of 0.001 through 30 weight %, and preferably 0.1 through 15 weight %. When the amount of the alkali earth metal oxide is less than 0.001 weight %, the effects by adding the alkali earth metal oxide, such as the increase of hardness, the decrease of oxidation, the increase of ignition temperature, and the reduction of the amount of a protection gas, may be reduced. When the additive is more than 30 weight %, the original properties of magnesium may be disappeared. The added additive is mainly alkali earth metal oxide. The alkali earth metal oxide may be CaO. In addition, the alkali earth metal oxide may be at least one of SrO, BeO or MgO and equivalent materials thereof.

In the stirring (S3), the magnesium molten metal is stirred 1 through 400 minutes and maintained. When the stirring is finished, the magnesium molten metal is maintained as it is in a predetermined period. In the periods of the adding and the stirring, the steps (S4, S5) are performed. When the time of the stirring is less than 1 minute, the additive is not satisfactorily mixed with the magnesium molten metal. When the time of the stirring is more than 400 minutes, the time of the stirring of the magnesium molten metal is unnecessarily longer. The time of the stirring depends on the amount of the molten metal and the amount of the added alkali earth metal oxide. In the stirring (S3), the time of the stirring of the magnesium molten metal may be 1 second through 60 minutes per 0.1 weight % of the alkali earth metal oxide added into the magnesium molten metal.

It is preferable that the stirring starts at the same time of the addition of the oxide powder. Otherwise, the oxide is heated to the predetermined temperature by transferring heat from the molten metal, and then the stirring starts to promote the reaction. The stirring continues until the added oxide powder is disappeared at the surface of the molten metal. After the alkali earth metal oxide is exhausted by the reaction, the stirring is finished. During the adding the additive into the magnesium-based molten metal and the stirring, the additive is reduced to calcium. Generally, the additive is more thermodynamically stable than the magnesium, it was expected that the calcium is not reduced in the magnesium molten metal and is not separated from the magnesium molten metal. However, according to the experimental results of the inventors of the present invention, the additive is reduced in the magnesium molten metal.

The calcium generated from the reduction can react with other elements in the base material, for example magnesium and/or aluminum, thereby forming a calcium-based compound. Thus, the additive is a calcium source for forming the calcium-based compound formed in the magnesium master alloy. The additive is an additive element added into the molten metal during forming the master alloy. However, the calcium-based compound is newly formed by reacting calcium provided from the additive with other elements in the base material. When the magnesium master alloy is made from a pure magnesium, the calcium-based compound may be a Mg—Ca compound, for example $Mg_2Ca$.

In addition, when the magnesium master alloy is formed from a magnesium alloy, for example a magnesium-aluminum alloy, the calcium-based compound includes at least one of a Mg—Ca compound, an Al—Ca compound and a Mg—Al—Ca compound. For example, the Mg—Ca compound may include $Mg_2Ca$, the Al—Ca compound may include at least one of $Al_2Ca$ and $Al_4Ca$, and the Mg—Al—Ca compound may include $(Mg,Al)_2Ca$.

Surface Reaction Through Surface Stirring of the Alkali Earth Metal Oxide

In the present invention, it is important to provide a reaction environment where the alkali earth metal oxide reacts on the surface of the molten metal rather than inside the molten metal. Thus, it is important not to forcibly stir the oxide floating on the surface of the molten metal into the molten metal. Simply, it is important to spread the alkaline earth metal oxide uniformly on the surface of molten metal exposed to air.

The reaction occurs better with stirring the molten metal than without stirring, and also the reaction occurs better at an outer surface (surface of an upper layer portion) rather than inside the molten metal. That is, the molten metal reacts better with the powder exposed to air at the outer surface (surface of an upper layer portion) thereof. However, results were not satisfactory under a state of vacuum or ambient gas. For sufficient reaction, it is necessary to induce the surface reaction through stirring of the upper layer portion.

For the surface stirring, the stirring is performed at an upper layer portion of which a depth is about 10% of a total depth of the molten metal from the surface of the molten metal. The substantially floating alkali earth metal oxide is induced to be positioned in an upper layer portion of which a depth is 10% of the actual depth of the molten metal, thereby minimizing the turbulence of the molten metal.

In the exhausting the alkali earth metal oxide (S4), through the reaction between the molten metal and the added alkali earth metal oxide, the alkali earth metal oxide is exhausted so as not to remain in the magnesium alloy at least partially or substantially. In the present invention, all of the alkali earth metal oxide input is preferably exhausted by the sufficient reaction. However, even if some portions do not react and remain in the alloy, it is also effective if these do not largely affect physical properties.

Herein, the exhausting of the alkali earth metal oxide involves removing an oxygen component from the alkali earth metal oxide. The oxygen component is removed in the form of oxygen gas ($O_2$) or in the form of a dross or a sludge through the combination with the magnesium or alloying components in the molten metal. The oxygen component is substantially removed out from the top surface of the molten metal by stirring the upper layer portion of the molten metal.

In an embodiment, for the pure magnesium and magnesium alloys, the reaction equations for reaction with calcium oxide are as follows.

Pure Mg+CaO−>Mg (Matrix)+$Mg_2Ca$. . . [generating $O_2$+generating MgO dross] Reaction equation 1

Mg Alloy+CaO−>Mg Alloy (Matrix)+($Mg_2Ca$+$Al_2Ca$+(Mg, Al, other alloy elements)$_2$Ca). . . [generating $O_2$+generating MgO dross] Reaction equation 2

In the performing reaction of the alkali earth metal (S5), an alkali earth metal produced by the exhaustion of the alkali earth metal oxide reacts with the molten metal so as not to at least partially or substantially remain in the magnesium alloy. Herein, this means that the alkali earth metal produced by the exhaustion is compounded with at least one of magnesium and aluminum in the magnesium alloy, and other alloying elements (components) in the molten metal, and is thus not left remaining substantially. Herein, a compound refers to an intermetallic compound obtained through bonding between metals.

Thus, the added alkali earth metal oxide is partially or substantially exhausted by removing the oxygen compound through the reaction with the molten metal, for example magnesium alloy, and the alkali earth metal in which the oxygen compound is removed makes a compound with at least one of magnesium, and aluminum in the magnesium alloy, and other alloying elements (components) in the molten metal, so that the alkali earth metal does not partially or substantially remain in the magnesium alloy.

When the stirring (S3) of the molten metal is finished, the magnesium-based molten metal is input in a mold to cast it (S4), the mold is cooled down, and thereafter a solidified master alloy is taken out from the mold (S7). Herein, in the casting (S6), the mold may be pre-heated. In addition, in the cooling (S6), the mold may be cooled down to a room temperature and then the master alloy may be taken out from the mold. However, before reaching the room temperature, the master alloy may be out from the mold when the solidification of the master alloy is finished.

Preparation Method for Eco-Zinc Alloy

Hereinafter, the preparation method of eco-zinc alloy using the eco-magnesium alloy according to an embodiment of the present invention will be described. Herein, the 'eco-zinc alloy' refers a zinc alloy formed by using the eco-magnesium master alloy. That is, the eco-zinc alloy is formed by using the eco-magnesium master alloy.

The preparation method of zinc alloy includes providing a zinc and a magnesium master alloy (an eco-magnesium-based master alloy) having a calcium-based compound, forming a molten metal in which the magnesium master alloy and the zinc are melted, and casting the molten metal.

Herein, in order to form the molten metal in which the magnesium master alloy and the zinc are melted, the zinc is first melted to form a zinc molten metal and then the magnesium master alloy (the eco-magnesium-based master alloy) having the calcium-based compound is input into the zinc molten metal to melt.

In other embodiment of the method, the zinc and the magnesium master alloy are input together in a melting apparatus such as crucible, and then are heated and melted together.

FIG. 2 is a flow chart illustrating a preparation method for a zinc alloy, according to an embodiment of the present invention. In the preparation method for the zinc alloy, a zinc molten metal is first formed, and then a magnesium master alloy formed by the method described above is added into the zinc molten metal and melted. As shown in FIG. 2, the preparation method for zinc alloy includes forming a zinc molten metal (S11), adding a magnesium master alloy (S12), stirring and maintaining (S13), casting (S14) and cooling (S15).

First, in the forming the zinc molten metal (S11), a zinc is input into a crucible and melted to form a zinc molten metal. The zinc in the forming the zinc molten metal (S11) is any one selected from a pure zinc, a zinc alloy, and equivalent materials thereof.

Next, in the adding the magnesium master alloy (S12), the magnesium master alloy formed by the above described method is added into the zinc molten metal. The magnesium master alloy (S12) used in the adding a magnesium master alloy (S12) is 0.01 through 46 weight % in the zinc alloy. When the amount of the magnesium master alloy is less than 0.01 weight %, the effects by adding the magnesium master alloy (hardness, corrosion resistance, weldability) is insignificant. In addition, the amount of the magnesium master alloy is more than 46 weight %, the original properties of the zinc alloy may be disappeared. Preferably, the magnesium master alloy may be 5 through 30 wt % in the zinc alloy.

The magnesium master alloy may be added as a bulk, but the present invention is not limited thereto. The magnesium master alloy may have a form of powder, granule, etc. In addition, the size of the magnesium master alloy is not limited.

When the magnesium master alloy is added, the calcium-based compound included in the magnesium master alloy is also provided into the zinc molten metal. As described above, the calcium-based compound provided into the zinc molten metal may include at least one of a Mg—Ca compound, an Al—Ca compound and a Mg—Al—Ca compound.

Herein, a small amount of a protection gas may be additionally provided in order to prevent the oxidation of the magnesium master alloy. The protection gas may include a conventional gas, such as $SF_6$, $SO_2$, $CO_2$, HFC-134a, Novec™ 612, noble gas and equivalent materials thereof, or mixed gas thereof. The addition of the protection gas may prevent the oxidation of the magnesium master alloy.

However, the protection gas is not essential in the present invention, and may not be provided. That is, in the embodiments of the present invention, when the magnesium master alloy having the calcium-based compound, the magnesium master alloy has a greater ignition resistance due to increasing oxidation resistance, thereby reducing the generation of impurities such as oxides in the molten metal, compared with the conventional case of adding magnesium without a calcium-based compound. Therefore, according to the preparation method of the present invention, the cleanness of the zinc molten metal is significantly improved even without the protection gas, thereby improving the quality of the molten metal.

Next, in the stirring and maintaining (S13), the zinc molten metal is stirred for 1 through 400 minutes and maintained. When the time of the stirring and maintaining is less than 1 minute, the magnesium master alloy is not satisfactorily mixed with the zinc molten metal. When the time of the stirring and maintaining is more than 400 minutes, the time of the stirring and maintaining of the zinc molten metal is unnecessarily longer. Next, when the stirring and maintaining (S13) of zinc molten metal is finished, the zinc molten metal is input in a mold to cast it (S14), the mold is cooled down, and thereafter a solidified zinc alloy is taken out from the mold (S7).

As described above, the magnesium master alloy is used for adding into the zinc alloy. As described above, the magnesium master alloy has the calcium-based compound formed by the reaction between calcium from the calcium-based additive and magnesium and/or aluminum during forming the magnesium master alloy. The calcium-based compound is an intermetallic compound and has a higher melting point than that of zinc (419.5° C.). For example, the melting points of $Al_2Ca$ and $Al_4Ca$ (Al—Ca compound) are 1079° C. and 700° C., respectively, and are higher than the melting point of aluminum.

Therefore, when the master alloy having the calcium-based compound is added into the zinc molten metal, the calcium-based compound cannot be melted in the molten metal and maintained as it is. When the molten metal is cast to form a zinc alloy, the zinc alloy may include the calcium-based compound.

Prevention of Oxidation and Ignition and Mechanical Properties of the Eco-Zinc Alloy As described above, when the magnesium master alloy having the calcium-based compound is added, the cleanness of the zinc molten metal is improved and the mechanical properties of the casted zinc alloy are also significantly improved. That is, there is no impurities such as oxides or inclusions degrading the mechanical properties in the zinc alloy casted, and the formation of bubbles inside the casted zinc alloy is significantly decreased. Since the inside of the casted zinc alloy has a more clean structure than that of a conventional zinc alloy, the zinc alloy according to the present invention has better mechanical properties such as a greater yield strength, a greater tensile strength and an improved elongation.

Therefore, even when a zinc alloy having the same amount of magnesium is formed, the present invention provides the better cleanness of the molten metal and better properties of the casted zinc alloy.

In addition, since the loss of magnesium added in zinc is decreased in the molten metal, even when the amount of magnesium is less added compared with the conventional case, the actual amount of the magnesium in the zinc alloy is substantially same, thereby providing economical advantages of forming a zinc alloy.

In addition, when the magnesium master alloy is added the zinc molten metal according to the present invention, the instability of magnesium in the zinc molten metal is significantly reduced compared with the conventional case, and then the amount of magnesium added may be increased.

Conventionally, magnesium is highly oxidized and thus oxides and inclusions formed by oxidizing magnesium may be inserted in the molten metal, thereby degrading the quality of the zinc alloy. This problem becomes worse as the amount of magnesium increases. Thus, the amount of the magnesium added in the zinc molten metal cannot be increased even by using a protection gas.

However, according to the present invention, since the magnesium master alloy can be stably added into the zinc molten metal, the amount of the magnesium in the zinc alloy can be easily increased compared with the conventional case, and the castability can be provided even in the increase of the amount of the magnesium. Therefore, by adding the magnesium master alloy according to the present invention into the zinc alloy, the mixing of oxides or inclusions are prevented, thereby improving castability, strength and elongation.

Mechanical Properties of the Eco-Zinc Alloy

Hereinafter, the properties of zinc alloy formed by the preparation method for zinc alloy of the present invention will be detailed described.

The zinc alloy according to the preparation method of the present invention includes a zinc base and a calcium-based compound existed in the zinc base. In the zinc base, magnesium may be dissolved.

As described above, calcium reduced from the calcium-based additive added into the magnesium master alloy is mostly existed as a calcium-based compound, and partially dissolved in the magnesium base. When the magnesium master alloy is added into the zinc molten metal, the calcium dissolved in the magnesium master alloy is diluted, and then the amount of the calcium dissolved in the base of the actual zinc alloy is less than the solubility limit.

The zinc alloy according to the present invention has improved mechanical properties due to the calcium-based compound formed in the magnesium master alloy. When the magnesium master alloy is added into the zinc molten metal, the calcium-based compound included in the magnesium master alloy is added together in the molten metal. The calcium-based compound is a intermetallic compound formed by reaction between calcium and other metal elements and has a melting point higher than that of zinc.

Therefore, when the master alloy having the calcium-based compound is added into the zinc molten metal, the calcium-based compound is not melted in the molten metal and maintained as it is. When the molten metal is casted to form a zinc alloy, the calcium-based compound may be existed in the zinc alloy.

The calcium-based compound may be distributed as fine particles in the zinc alloy. Herein, the calcium-based compound is an intermetallic compound, has a greater strength than the zinc of the base material. Due to the distribution of the high strength matter, the strength of the zinc alloy may be increased.

During the phase transition from a liquid phase to a solid phase of the calcium-based compound, sites of nucleation can be provided. That is, when the zinc alloy is solidified, the phase transition from a liquid phase to a solid phase occurs as a form of nucleation and growth. Herein, the calcium-based compound itself functions as a heterogeneous nucleation site, and the nucleation for phase transition to solid phase preferentially occurs at the interface of the calcium-based compound and the liquid phase. The solid phase formed by the nucleation is created around the calcium-based compound and grows.

When a plurality of the calcium-based compounds are distributed, solid phases grown at the interfaces of the calcium-based compounds meet each other for form boundaries. These boundaries becomes grain boundaries or phase boundaries. Accordingly, when the calcium-based compound functions as a nucleation site, the calcium-based compound exists in the grains or phase domains, thereby decreasing the sizes of the grains or phase domains compared with the case that the calcium-based compound is not presented.

The calcium-based compound may be distributed in grain boundaries between grains or in phase boundaries between phase domains. These boundaries have open structures compared with the insides of the grains or phase domains and have relatively higher energy states, thereby providing sites for nucleation and growth of the calcium-based compound.

When the calcium-based compounds are distributed in the grain boundaries or the phase boundaries of the zinc alloy, the calcium-based compound functions as obstacles for the movement of the grain boundaries or the phase boundaries, thereby decreasing the average size of the grains or phase boundaries.

Accordingly, the zinc alloy of the present invention has a smaller average grains or phase domains compared with the zinc alloy without the calcium-based compound.

The decrease of the sizes of the grains or phase domains due to the calcium-based compound improves the strength and elongation of the aluminum alloy.

That is, as described above, when the magnesium master alloy formed by adding the additive according to the preparation method for zinc alloy of the present invention is used, the amount of the magnesium added in the zinc molten metal may be stably increased, thereby increasing the solubility amount of the magnesium dissolved in the zinc base.

The increase of solubility amount of the magnesium can provides a high zinc alloy strength due to solid-solution strengthening and heat treatment, and better castability and mechanical properties compared with the conventional alloy.

EXPERIMENTAL EXAMPLES

Hereinafter, experimental examples will be provided to understand the present invention. However, the following experimental examples are provided only for understanding the present invention, but the present invention is not limited by the following experimental examples.

FIGS. 3 to 6 are results of states of the zinc molten metal formed by adding a conventional magnesium master alloy, and FIGS. 7 to 10 are results of states of the zinc molten metal formed by adding an eco-magnesium master alloy.

FIG. 3 is a photograph illustrating a surface of a molten metal when a zinc alloy with a final composition of Zn-5 weight % Mg is formed by adding a conventional magnesium master alloy into a zinc molten metal.

In this specification, a zinc alloy using a conventional magnesium master alloy refers a 'conventional zinc alloy'. That is, the conventional zinc alloy is formed by using a conventional magnesium master alloy. Herein, the conventional magnesium master alloy refers a magnesium alloy formed by using the conventional magnesium not by using an eco-magnesium. The conventional zinc alloy, rapid oxidation and ignition was found on the surface of the molten metal during the solidification process after the casting process. To prevent this, a protection gas such as $SF_6$ is added on the surface of the molten metal.

During the formation of an alloy, the compositions of the zinc alloys used to confirm the generation of the oxidation and ignition of the zinc alloy are Zn-5 weight % Mg (FIG. 3), Zn-10 weight % Mg-10 weight % Al (FIG. 4), Zn-30 weight % % Mg-20 weight % Al (FIG. 5), and Zn-45 weight % Mg-5 weight % Al (FIG. 6).

FIG. 4 is a photograph illustrating a surface of a molten metal when a zinc alloy with a final composition of Zn-10 weight % Mg-10 weight % Al is formed by adding a conventional magnesium master alloy into a zinc molten metal.

FIG. 5 is a photograph illustrating a surface of a molten metal when a zinc alloy with a final composition of Zn-30 weight % Mg-20 weight % Al is formed by adding a conventional magnesium master alloy into a zinc molten metal.

FIG. 6 is a photograph illustrating a surface of a molten metal when a zinc alloy with a final composition of Zn-45 weight % Mg-5 weight % Al is formed by adding a conventional magnesium master alloy into a zinc molten metal.

FIG. 7 is a photograph illustrating a surface of a molten metal when a zinc alloy with a final composition of Zn-5 weight % Mg is formed by adding an eco-magnesium master alloy into a zinc molten metal.

A zinc alloy formed by using an eco-magnesium master alloy refers an 'eco-zinc alloy'. That is, the eco-zinc alloy is formed by using the eco-magnesium master alloy. Herein, the eco-magnesium refers the magnesium alloy formed by adding CaO into the molten metal of the magnesium (alloy) and stirring the surface thereof to generate a surface reaction when the magnesium alloy is formed. The final compositions of the eco-zinc alloys are Zn-5 weight % Mg (FIG. 7), Zn-10 weight % Mg-10 weight % Al (FIG. 8), Zn-30 weight % Mg-20 weight % Al (FIG. 9), and Zn-45 weight % Mg-5 weight % Al (FIG. 10). For the case of the eco-zinc alloy, the oxidation or ignition did not occur on the surface of the molten metal during the solidification process after the casting process, even when the protection gas was not used.

All of the Zn-5 weight % Mg, Zn-10 weight % Mg-10 weight % Al, Zn-30 weight % Mg-20 weight % Al, and Zn-45 weight % Mg-5 weight % Al of eco-zinc alloys have 5 weight % Ca in the eco-magnesium master alloy, contrary to the conventional zinc alloy of FIGS. 3, 4, 5 and 6. For the case of the eco-magnesium, Mg or Mg alloy includes Ca by reducing CaO due to the surface reaction through the surface stirring using CaO. The eco-magnesium master alloy added into four eco-zinc alloy includes 1.5 weight % Ca. Herein, 1.5 weight % Ca is the ratio of Ca contents in the forming the master alloy, and thus the Ca contents in the final eco-zinc alloy becomes much less because the Ca contents in the final eco-zinc alloy depends on the amount of the eco-magnesium master alloy.

FIG. 8 is a photograph illustrating a surface of a molten metal when a zinc alloy with a final composition of Zn-10 weight % Mg-10 weight % Al is formed by adding an eco-magnesium master alloy into a zinc molten metal.

FIG. 9 is a photograph illustrating a surface of a molten metal when a zinc alloy with a final composition of Zn-30 weight % Mg-20 weight % Al is formed by adding an eco-magnesium master alloy into a zinc molten metal.

FIG. 10 is a photograph illustrating a surface of a molten metal when a zinc alloy with a final composition of Zn-45 weight % Mg-5 weight % Al is formed by adding an eco-magnesium master alloy into a zinc molten metal.

Referring to FIGS. 3 to 6 and FIGS. 7 to 10, the state of the molten metal of the eco-zinc alloy is satisfactory, while the surface of the molten metal of the conventional zinc alloy shows a black color and the amount of dross is increased.

Table 1 shows the dross weight created in forming alloy by adding the conventional magnesium master alloy and the eco-magnesium master alloy with various compositions into the zinc molten metal.

FIG. 11 is a photograph illustrating a shape of a dross when a zinc alloy with a final composition of Zn-5 weight % Mg is formed by adding a conventional magnesium master alloy into a zinc molten metal.

FIG. 11 shows the shape of dross formed on a surface of the molten metal during the forming of the conventional zinc alloy. The final compositions of the conventional zinc alloys are Zn-5 weight % Mg (FIG. 11), Zn-10 weight % Mg-10 weight % Al (FIG. 12), Zn-30 weight % Mg-20 weight % Al (FIG. 13), and Zn-45 weight % Mg-5 weight % Al (FIG. 14). For the conventional zinc alloys, oxidation and ignition rapidly occurred on the surface of the molten metal during the solidification process after the casting process, and thus a protection gas such as $SF_6$ was used in order to prevent the oxidation and ignition of the molten metal.

FIG. 12 is a photograph illustrating a shape of a dross when a zinc alloy with a final composition of Zn-10 weight % Mg-10 weight % Al is formed by adding a conventional magnesium master alloy into a zinc molten metal.

FIG. 13 is a photograph illustrating a shape of a dross when a zinc alloy with a final composition of Zn-30 weight % Mg-20 weight % Al is formed by adding a conventional magnesium master alloy into a zinc molten metal.

FIG. 14 is a photograph illustrating a shape of a dross when a zinc alloy with a final composition of Zn-45 weight % Mg-5 weight % Al is formed by adding a conventional magnesium master alloy into a zinc molten metal.

FIG. 15 is a photograph illustrating a shape of a dross when a zinc alloy with a final composition of Zn-5 weight % Mg is formed by adding an eco-magnesium master alloy into a zinc molten metal.

TABLE 1

| | Zn—5Mg | Zn—10Mg—10Al | Zn—30Mg—20Al | Zn—45Mg—5Al |
|---|---|---|---|---|
| Conventional zinc alloy | 540 g | 306 g | 218 g | 285 g |
| Eco-zinc alloy | 78 g | 32 g | 50 g | 55 g |

The amounts of dross during forming the conventional zinc alloy (FIG. 11 through FIG. 14) and the eco-zinc alloy (FIG. 15 through FIG. 18) were measured and compared. Referring to Table 1, the amount of the impurities (the amount of the dross) floated on the surface of the molten metal of the eco-zinc alloy formed by adding the eco-magnesium master alloy is much less compared with the conventional zinc alloy formed by adding the conventional magnesium master alloy.

That is, the amount of the dross in the conventional zinc alloy is much greater than that of the eco-zinc alloy. It can be found all alloys, such as the alloy of Zn-5 weight % Mg (FIG. 11 for the conventional zinc alloy and FIG. 15 for the eco-zinc alloy), the alloy of Zn-10 weight % Mg-10 weight % Al ((FIG. 12 for the conventional zinc alloy and FIG. 16 for the eco-zinc alloy), the alloy of Zn-30 weight % Mg-20 weight % Al ((FIG. 13 for the conventional zinc alloy and FIG. 17 for the eco-zinc alloy), and the alloy of Zn-45 weight % Mg-5 weight % Al (FIG. 14 for the conventional zinc alloy and FIG. 18 for the eco-zinc alloy).

Therefore, when a is formed by the present invention, the loss of the magnesium is significantly decreased compared with the use of the conventional magnesium master alloy. In addition, when the eco-magnesium master alloy is added, the fluidity of the molten metal and the hardness of the zinc alloy are improved compared with the use of the conventional magnesium master alloy.

The shapes of dross formed on a surface of the molten metal during the forming of the eco-zinc alloy are shown. The final compositions of the eco-zinc alloys are Zn-5 weight % Mg (FIG. 15), Zn-10 weight % Mg-10 weight % Al (FIG. 16), Zn-30 weight % Mg-20 weight % Al (FIG. 17), and Zn-45 weight % Mg-5 weight % Al (FIG. 18). For the eco-zinc alloys, oxidation and ignition did not occurred on the surface of the molten metal during the solidification process after the casting process, and thus the amount of the dross is smaller compared with the conventional zinc alloys.

FIG. 16 is a photograph illustrating a shape of a dross when a zinc alloy with a final composition of Zn-10 weight % Mg-10 weight % Al is formed by adding an eco-magnesium master alloy into a zinc molten metal.

FIG. 17 is a photograph illustrating a shape of a dross when a zinc alloy with a final composition of Zn-30 weight % Mg-20 weight % Al is formed by adding an eco-magnesium master alloy into a zinc molten metal.

FIG. 18 is a photograph illustrating a shape of a dross when a zinc alloy with a final composition of Zn-45 weight % Mg-5 weight % Al is formed by adding an eco-magnesium master alloy into a zinc molten metal.

FIGS. 19 through 26 show results of comparing a surface of a cast product of the zinc molten metal with a conventional magnesium master alloy and a surface of a cast product of the zinc molten metal with an eco-magnesium master alloy.

FIG. 19 is a photograph illustrating an oxidation and ignition state of a surface of a casting product during solidification process after forming a zinc alloy with a final composition of Zn-5 weight % Mg by adding a conventional magnesium master alloy into a zinc molten metal.

In the conventional zinc alloys (Zn-5 weight % Mg, Zn-10 weight % Mg-10 weight % Al, Zn-30 weight % Mg-20 weight % Al, and Zn-45 weight % Mg-5 weight % Al), oxides were rapidly formed on the surface of the cast products during the solidification process after the casting process due to the magnesium added.

FIG. 20 is a photograph illustrating an oxidation and ignition state of a surface of a casting product during solidification process after forming a zinc alloy with a final composition of Zn-10 weight % Mg-10 weight % Al by adding a conventional magnesium master alloy into a zinc molten metal.

FIG. 21 is a photograph illustrating an oxidation and ignition state of a surface of a casting product during solidification process after forming a zinc alloy with a final composition of Zn-30 weight % Mg-20 weight % Al by adding a conventional magnesium master alloy into a zinc molten metal.

FIG. 22 is a photograph illustrating an oxidation and ignition state of a surface of a casting product during solidification process after forming a zinc alloy with a final composition of Zn-45 weight % Mg-5 weight % Al by adding a conventional magnesium master alloy into a zinc molten metal.

FIG. 23 is a photograph illustrating an oxidation and ignition state of a surface of a casting product during solidification process after forming a zinc alloy with a final composition of Zn-5 weight % Mg by adding an eco-magnesium master alloy into a zinc molten metal.

In the eco-zinc alloys (Zn-5 weight % Mg, Zn-10 weight % Mg-10 weight % Al, Zn-30 weight % Mg-20 weight % Al, and Zn-45 weight % Mg-5 weight % Al from the left), oxides were not formed on the surface of the cast products during the solidification process after the casting process.

FIG. 24 is a photograph illustrating an oxidation and ignition state of a surface of a casting product during solidification process after forming a zinc alloy with a final composition of Zn-10 weight % Mg-10 weight % Al by adding an eco-magnesium master alloy into a zinc molten metal.

FIG. 25 is a photograph illustrating an oxidation and ignition state of a surface of a casting product during solidification process after forming a zinc alloy with a final composition of Zn-30 weight % Mg-20 weight % Al by adding an eco-magnesium master alloy into a zinc molten metal.

FIG. 26 is a photograph illustrating an oxidation and ignition state of a surface of a casting product during solidification process after forming a zinc alloy with a final composition of Zn-45 weight % Mg-5 weight % Al by adding an eco-magnesium master alloy into a zinc molten metal.

Referring to FIGS. 19 to 26, the cast products of the zinc alloy where the eco-magnesium master alloy is added have clean surfaces, compared with the cast products of the zinc alloy where the conventional magnesium master alloy is added. This means that castability is improved by the calcium oxide (CaO) added into the eco-magnesium master alloy. That is, the zinc alloy where the conventional magnesium master alloy is added shows a ignition phenomena on the surface thereof due to the oxidation of the magnesium during casting, while the zinc alloy where the eco-magnesium master alloy having additive (calcium oxide, CaO) is added shows a clean surface due to the restriction of the ignition phenomena.

Therefore, when the eco-magnesium master alloy is added, the qualities of the molten metal are significantly improved, thereby improving castability, compared with the case of adding the conventional magnesium master alloy.

While the present invention has been particularly shown and described with reference to preferred embodiments thereof, it will be understood by those skilled in the art that various changes in form and details may be made therein without departing from the sprit and scope of the invention as defined by the appended claims. Therefore, the scope of the invention is defined not by the detailed description of the invention but by the appended claims, and all differences within the scope will be construed as being included in the present invention.

What is claimed is:

1. A preparation method for a zinc alloy, the method comprising:
- providing a zinc;
- providing a magnesium master alloy that includes a calcium-based compound;
- forming a molten metal in which the magnesium master alloy and the zinc are melted; and
- casting the molten metal,
- wherein the providing of the magnesium master alloy comprises:
  - forming a magnesium melt by melting the pure magnesium or the magnesium alloy;
  - adding a calcium-based additive to the magnesium melt; and
  - stirring the magnesium melt and the calcium-based additive in an upper portion of the magnesium melt,
- wherein the calcium-based additive is powder,
- wherein the calcium-based additive is added in a range from 0.001 to 30 weight % with respect to the pure magnesium or the magnesium alloy,
- wherein the stirring is performed in the upper portion of which a depth is about 10% of a total depth of the magnesium melt from the surface thereof, and
- wherein a plurality of particles of the calcium-based compound are disposed inside grains of the zinc alloy.

2. The method of claim 1, wherein the forming of the molten metal comprises:
- forming a zinc molten metal by melting the zinc; and
- adding the magnesium master alloy into the zinc molten metal and meting the magnesium master alloy.

3. The method of claim 1, wherein the forming of the molten metal comprises:
- inputting the magnesium master alloy and the zinc into a melting furnace; and
- melting the magnesium master alloy and the zinc together.

4. The method of claim 1, wherein the magnesium master alloy is 0.01 through 46 weight % in the zinc alloy.

5. The method of claim 4, wherein the magnesium master alloy is 5 through 30 weight % in the zinc alloy.

6. The method of claim 1, wherein the magnesium alloy comprises aluminum.

7. The method of claim 6, wherein the calcium-based additive comprises at least one of alkali earth metal oxides.

8. The method of claim 7, wherein the alkali earth metal oxide is calcium oxide.

9. The method of claim 7, wherein the calcium-based compound is formed by reacting calcium provided by the calcium-based additive with an element in the pure magnesium or the magnesium alloy.

10. The method of claim 9, wherein the calcium-based compound comprises at least one of a Mg—Ca compound, an Al—Ca compound and a Mg—Al—Ca compound.

11. The method of claim 10, wherein the Mg—Ca compound comprises $Mg_2Ca$.

12. The method of claim 1, wherein the zinc is pure zinc or a zinc alloy.

* * * * *